United States Patent [19]

Colombo et al.

[11] Patent Number: 4,703,792

[45] Date of Patent: Nov. 3, 1987

[54] EXTRACTOR/STRAIGHTENER DEVICE FOR CONTINUOUS CASTING INSTALLATIONS

[75] Inventors: Piero Colombo; Daniele Comelli, both of Udine, Italy

[73] Assignee: Continua International Continuous Casting S.p.A., Ferrara, Italy

[21] Appl. No.: 1,242

[22] Filed: Jan. 7, 1987

[30] Foreign Application Priority Data

Jan. 7, 1986 [IT] Italy ..... 12402 A/86

[51] Int. Cl.[4] ..... B22D 11/128

[52] U.S. Cl. ..... 164/442; 164/448

[58] Field of Search ..... 164/441, 442, 447, 448

[56] References Cited

U.S. PATENT DOCUMENTS 3,426,835 2/1969 Michelson .

4,290,479 9/1981 Colombo .

*Primary Examiner*—Kuang Y. Lin

*Attorney, Agent, or Firm*—King & Schickli

[57] ABSTRACT

This invention relates to an extractor/straightener device for continuous metal casting installations, particularly for curved continuous casting. In order to cast either round-section strands and square-, rectangular- or polygonal-section strands, the extractor/straightener device (10) comprises two successive pairs of extractor rollers, one pair including rollers (11, 12) with a groove or race therein (15) for round-section strands (7'), the other pair including cylindrical rollers (13, 14) for square-section strands (7''). The two pairs of extractor rollers (11, 12 and 13, 14) are followed by a straightener roller (31). Means are provided to regulate the distance between the rollers (11, 12 and 13, 14) of each pair of extractor rollers so as to exert a tractive action on the strand (7' or 7''), alternately, by means of either the former or the latter pair of said rollers (11, 12 or 13, 14) depending upon the profile of said strand.

6 Claims, 6 Drawing Figures

1
2
3
4
5
6
7
8
9
10

EXTRACTOR/STRAIGHTENER DEVICE FOR CONTINUOUS CASTING INSTALLATIONS

SUMMARY OF THE INVENTION

This invention relates to an extractor/straightener device to be used in an installation for the continuous casting of metals, particularly steel, and in an installation for the curved continuous casting, wherein a strand is cast in a substantially vertical direction, particularly by means of an arcuate, open-ended mold, and follows first a curved path of travel which is then turned into a substantially horizontal direction by passing through an extractor/straightener device.

The invention aims to provide an extractor/straightener device of the type mentioned above, which enables the casting of round-section strands and of square-, rectangular- or polygonal-section strands. For this purpose, the extractor/straightener device of the invention comprises two successive pairs of extractor rollers, one pair including rollers with a groove or race therein for round-section strands, and the other pair including cylindrical rollers for square-, rectangular- or polygonal-section strands, means being provided to regulate the distance between the rollers of each pair of extractor rollers, so as to exert a tractive action on said strand, alternately, by means of either the former or the latter pair of said extractor rollers, depending upon the profile of said strand.

The two successive pairs of extractor rollers of the invention may be actuated each by its own motivating unit. Preferably, however, according to a further characteristic of the invention, the two successive pairs of extractor rollers are provided with a single motivating unit which is or may be coupled with both pairs of extractor rollers through any suitable drive, e.g. a chain drive means which will actuate, through vertical shafts, suitable worm/helical gear drive systems which are associated each with an extractor roller. A particularly simple and economical embodiment is thus obtained. Of course, suitable clutches or couplings may be provided to connect the common motivating unit, alternately, to either pair of extractor rollers.

According to a further embodiment of the invention, the pair of grooved extractor rollers for round-section strands is arranged upstream of the cylindrical extractor rollers for square-section or similar strands, and the menas for regulating the distance between the grooved extractor rollers of the first pair of extractor rollers permits such a spacing apart of said extractor rollers as to allow the passage of the not yet straightened square-section strand. Preferably, in this instance, the lower grooved extractor roller of the first pair of extractor rollers for round-section strands is also movable vertically; said lower roller, when a round-section strand is being cast, is raised to such a position whereby the bottom of its groove is at the same level as the peripheral surface of the lower cylindrical roller of the successive pair of extractor rollers for strands of square or similar section, whereas it is lowered below said position when a square-section or similar strand is being cast.

BRIEF DESCRIPTION OF THE DRAWINGS

These and other characteristics of the invention and the advantages resulting therefrom will be more apparent from the following description of a preferred embodiment thereof, shown as a non-limiting example in the accompanying drawings, wherein.

DESCRIPTION OF THE PREFERRED EMBODIMENT

Figure 1:
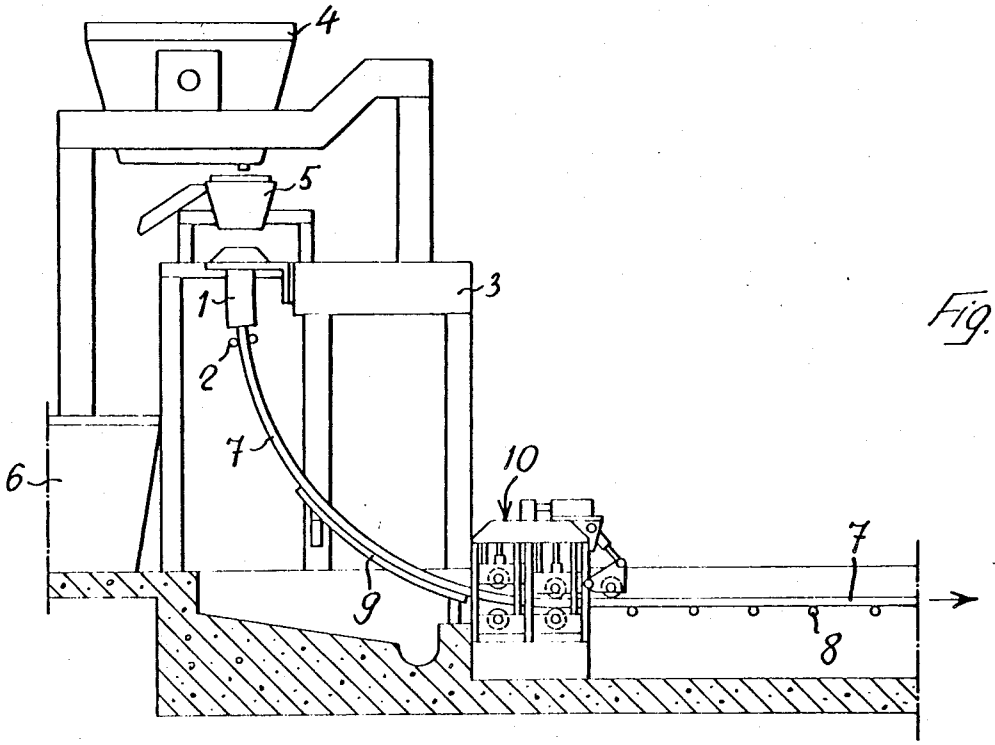
FIG. 1 is a diagrammatic side elevational view of a curved continuous casting installation comprising an extractor/straightener device according to the invention.

With reference to FIG. 1, the numeral 1 indicates the open-ended ingot mold of an installation for the continuous casting of metals, particularly of steel. The mold 1 may be constructed, or may be replaced, so as to selectively cast either round-section strands or sqaure-, rectangular- or polygonal-section strands.

The mold 1 is of curved configuration and is connected with rollers 2 arranged at the bottom outlet thereof and, optionally, it may be followed by a short curved cage of guide rollers (not shown) which is either integral with said mold 1 or separate and independent thereof. The mold 1 is swingably movable and it may be actuated by an oscillating unit 3. The ladle 4 pours the molten metal into the underlying tundish 4, and the latter will dispense it, generally, into a pair of more underlying molds 1, each associated with a casting line. In case of emergency, the molten metal in the intermediate tundish 5 may be poured into a pail 6.

The cast strand 7, emerging in a substantially vertical or nearly vertical direction from the mold 1, follows first a curved path of travel having the profile of an arc of circumference and then emerges therefrom and turns into a substantially horizontal direction, for example, in a runway 8. Preferably, the initial portion of the curved path of travel of the cast strand 7 is completely devoid of guide means for said strand. The remaining portion of said curved path of travel, below the cooling spray chamber (not shown) is provided, preferably, with strand-guide means of any construction, for example, idle rollers arranged at least on the extrados side and/or a strand-guide chute 9 made of plate and arranged on the extrados side.

Figure 2:
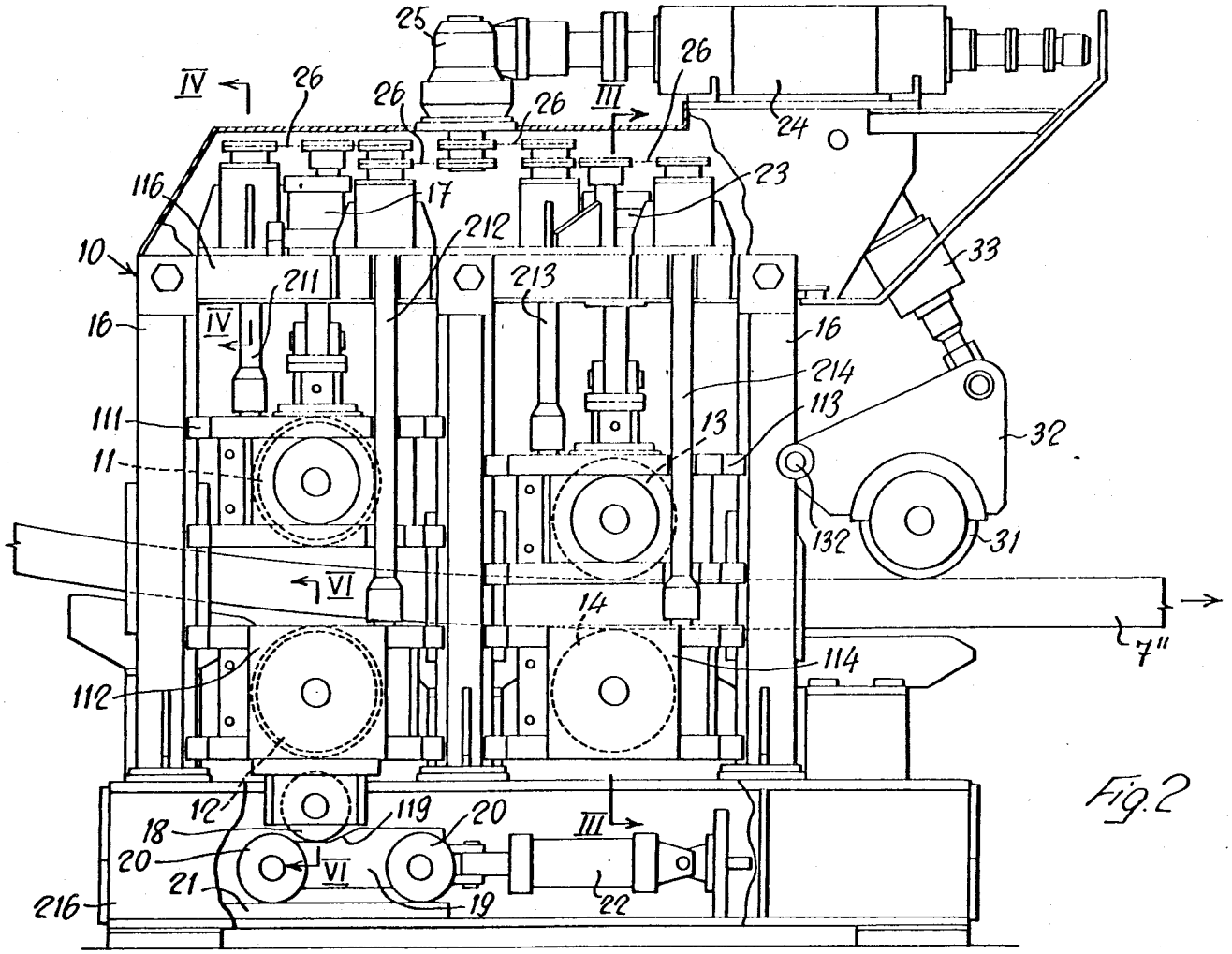
FIG. 2 is an enlarged side elevational view of the extractor/straightener device.
Figure 3:
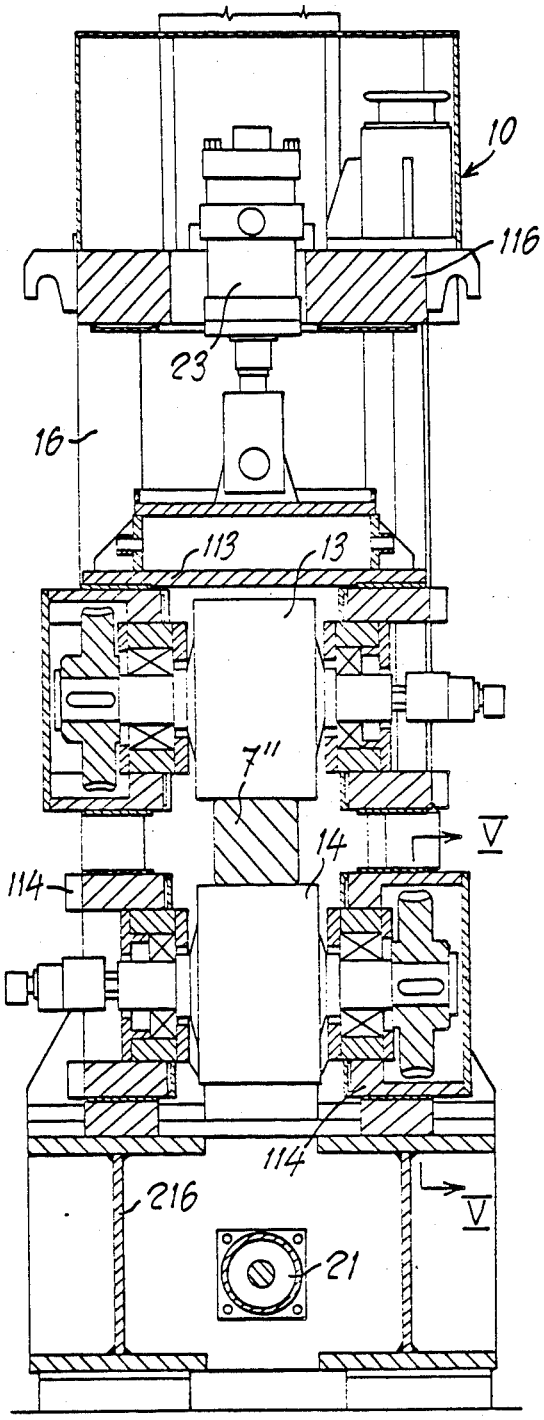
FIG. 3 is a cross sectional view of the extractor/straightener device, taken through the pair of extractor rollers for square-section stands, on the line III—III of FIG. 2.
Figure 4:
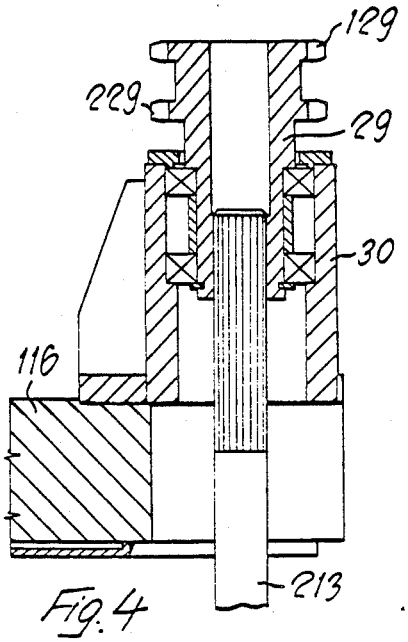
FIGS. 4 and 5 are enlarged fragmentary sectional views on the lines IV—IV of FIG. 2 and V—V of FIG. 3, respectively.
Figure 5:
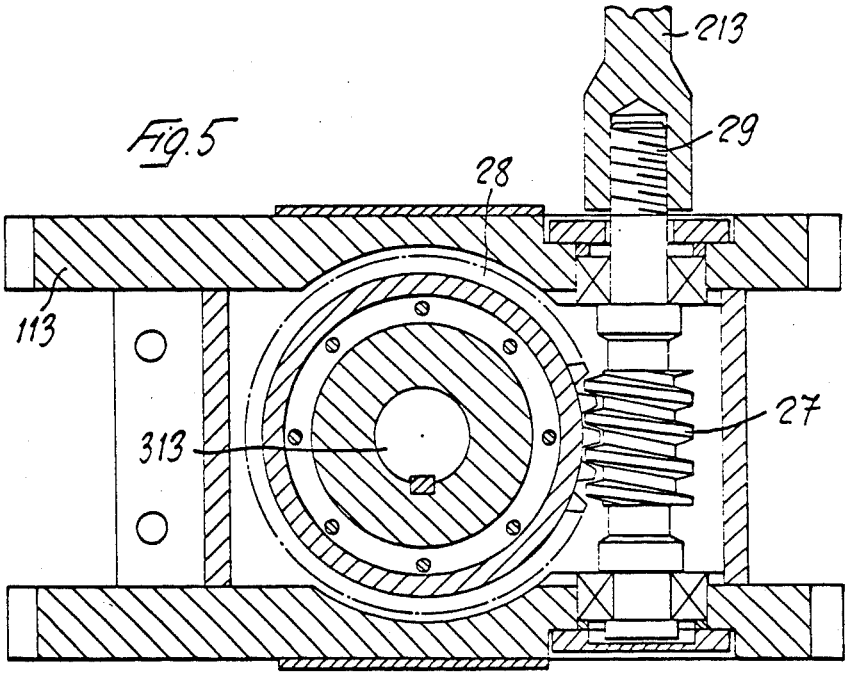
Figure 6:
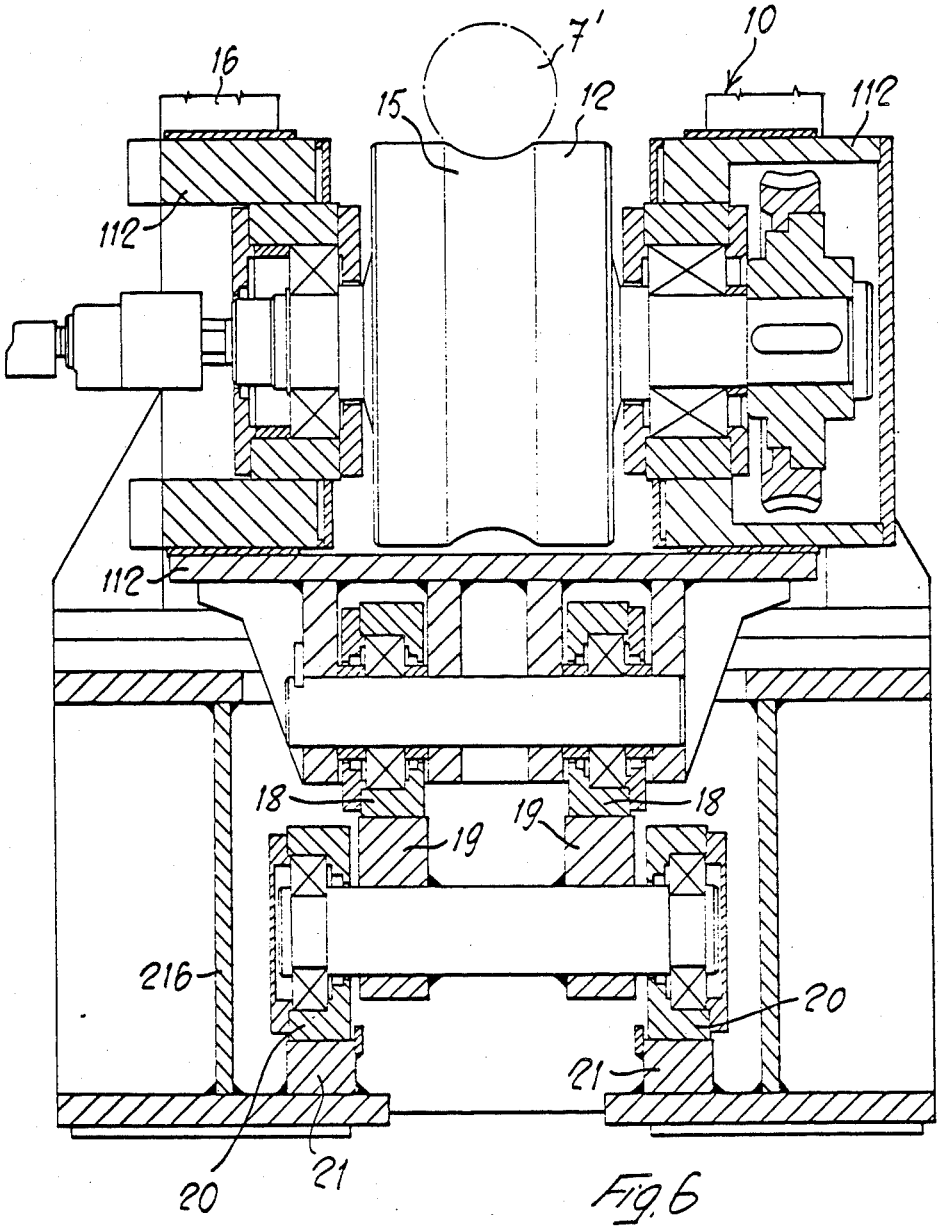
FIG. 6 is an enlarged fragmentary sectional view on the line VI—VI of FIG. 2.

At the end of said curved path of travel, between the latter and the adjacent rectilinear, horizontal path of travel of the cast strand 7, there is arranged an extractor/straightener device 10, shown with more detail in the FIGS. 2 to 6. With reference to these figures, said extractor/straightener device comprises two successive pairs of superimposed extractor rollers 11, 12 and 13, 14. The former pair of extractor rollers 11, 12 is designed to operate with round-section cast strands 7'; therefore, these rollers 11, 12 are formed with an annular groove 15 having the configuration of a sector of a circle, as shown for the lower extractor roller 12 in FIG. 6. The successive pair of extractor rollers 13, 14 is designed to operate with strands of square, rectangular or similar section, and thus these rollers 13, 14 are of cylindrical configuration, as best shown in FIG. 3.

The extractor rollers 11, 12 for round-section strands are rotatably supported each in a slide 111, 112, and both these supporting slides 111, 112 are vertically slidably mounted in suitable guides on the frame 16 of the device, for example, on vertical standards or the like. The slide 111 for the upper extractor roller 11 may be lifted and lowered by means of an upper hydraulic cylinder 17 carried by the upper portion 116 of the frame 16 of the device. The slide 112 for the lower extractor roller 12, however, is supported through a pair of wheels 18 on the upper stepped surface 119 of two parallel cams 19 constituting a carriage which is movable by means of wheels 20 on the rails 21 in the baseplate 216 of the device. By moving the carriage-cams 19 in either direction on the rails 21 by means of a hydraulic cylinder 22, the slide 112 if either lifted or lowered together with the lower extractor roller 12 by the action of the stepped surface 119 of said cams 19.

The lower extractor roller 14 for square-section strands is rotatably mounted in a support 114 which may be firmly positioned on the baseplate 216 of the device. The upper extractor roller 13 for round-section strands is rotatably mounted in a slide 113 which is vertically slidably mounted in suitable guides on the frame 16 of the device, for example, on standards or the like, and it may be either lifted and lowered by means of a hydraulic cylinder 23.

All the extractor rollers 11, 12, 13 and 14 are actuated by a common motivating unit 24 which is arranged, for example, on the upper portion 116 of the frame of the device and is coupled, for example, by means of a bevel drive 25 and a plurality of chain drives 26, to four vertical shafts 211, 212, 213 and 214 each associated with one of the extractor rollers 11, 12, 13 and 14 and each coupled with the respective roller by means of a respective worm 27 and helical gear 28. This type of drive is shown with more detail on the FIGS. 4 and 5 for the upper extractor roller 13 for square-section strands. The vertical shaft 213 associated with said roller 13 is coupled at its lower end, for example through a screw connection 29, with the co-axial shaft of the worm 27 which is in mesh with the corresponding helical gear 28 keyed to the shaft 313 of the extractor roller 13. The top end of the vertical shaft 213 is axially slidably coupled for rotation, e.g. by means of a splined connection, with a co-axial sleeve 29 which is rotatably but not axially slidably mounted in a stationary supporting structure 30 secured on the upper portion 116 of the frame 16. The sleeve 29 is integral with a toothed wheel 129 for the chain drive 26 which couples said sleeve with the motivating unit.

The extractor roller 13, thus, may be moved vertically together with its supporting slide 113, while remaining coupled for rotation with the motivating unit 24. The sleeve 29 may be made integral with a further toothed wheel 229 for a chain 26 which drives another vertical shaft, specifically the shaft 214 for actuating the other extractor roller 14 for square-section strands. The actuating means for the extractor rollers 11, 12 for round-section strands are of similar construction.

Downstream of the two pairs of extractor rollers 11, 12 and 13, 14, the extractor/straightener device 10 comprises a straightener roller 31 carried by an oscillating support 32 which is pivoted at 132 to the frame 16 of the device and may be moved by a hydraulic cylinder 33. The straightener roller 31 may be constituted by a cylindrical roller for both round-section strands 7' and square-section strands or the like 7''. However, if necessary, when round-section strands 7' are being cast a grooved straightener roller may be substituted for the cylindrical straightener roller 31.

The extractor/straightener device shown in the FIGS. 2 and 3 is prearranged to cast square-section strands 7''. For this purpose, the distance between the two cylindrical extractor rollers 13 and 14 of the second pair of rollers 13, 14 is regulated, by vertically displacing the slide 113 which supports the upper extractor roller 13, as a function of the thickness of the square- or rectangular-section strand 7''. Conversely, the pair of extractor rollers 11, 12 for round-section strands is opened by lifting the slide 111 supporting the upper extractor roller 11 and by lowering the slide 112 supporting the lower extractor roller 12 so that the still arcuate square-section strand 7'' may pass unobstructed and without interferring therewith, as shown in FIG. 2.

When round-section strands 7' are to be cast, the slide 112 supporting the lower extractor roller 12 is lifted so as to bring the bottom of the peripheral groove 15 of said roller 12 at the same level as the cylindrical peripheral surface of the lower extractor roller 14 of the successive pair of extractor rollers 13, 14. Conversely, the slide 111 supporting the upper extractor roller 11 is lowered so as to bring its upper extractor roller 11 to the required distance from the corresponding lower extractor roller 12, depending upon the diameter to the round strand 7' being cast. The level of upper extractor roller 13 for the square-section strand 7'' may be regulated so that said roller 13 can or cannot contact the underlying straightened round strand 7'.

Of course, the invention is not limited to the embodiment herein described and shown, but broad changes and modifications, especially of constructional nature, may be made thereto and particularly to the means for adjusting the level and for the rotation of the rollers of the two successive pairs of extractor rollers 11, 12 and 13, 14, the former being designed for operating with round-section strands and the latter for operating with square-, rectangular-, polygonal-section strands or the like, without departing from the basic principle set forth above and claimed hereinafter. Particularly, the extractor device according to the invention may be used not only in installations for curved continuous casting, but as well in installations for horizontal continuous casting.

We claim:

1. An extractor/straightener device for continuous metal casting installations, particularly for curved continuous casting, wherein the strand (7) which is cast in a substantially vertical direction, specifically through an open-ended curved mold (1), may have either a round-section or a square-, rectangular-, polygonal-section or the like, and it follows first a curved path of travel wherefrom it emerges to turn into a substantially horizontal direction by passing through said extractor/-straightener device (10), characterized in that it comprises two successive pairs of extractor rollers, one pair including rollers (11, 12) with a groove or race therein (15) for round-section strands (7') and the other with cylindrical rollers (13, 14) for square-, rectangular-or polygonal-section strands (7''), these two pairs of extractor rollers (11, 12 and 13, 14) being followed by a straightener roller (31) and means being provided to regulate the distance between the rollers (11, 12 and 13, 14) of each pair of extractor rollers, such as to exert a tractive force on the strand (7' or 7'') alternately by the former or the latter of said pairs of extractor rollers (11, 12 or 13, 14) depending upon the profile of said strand.

2. A device according to claim 1, characterized in that the pair of extractor rollers (11, 12) formed with a groove (15) for round-section strands (7') is arranged upstream of the pair of cylindrical extractor rollers (13, 14) for square-section or similar strands (7''), and the means for regulating the distance between the grooved (15) extractor rollers (11, 12) of the first pair of extractor rollers permit such a spacing apart of these extractor rollers (11, 12) as to allow an unhindered passage of the not yet straightened strand of square or similar section.

3. A device according to claim 2, characterized in that the lower extractor grooved (15) roller (12) of the first pair of extractor rollers (11, 12) for round-section strands (7') is also displaceable vertically and, when a round-section strand (7') is being cast, said lower roller (12) may be lifted to such a position whereby the bottom of its groove (15) will be at the same level as the peripheral surface of the cylindrical lower roller (14) of the successive pair of extractor rollers (13, 14) for strands of square or similar section, whereas it may be lowered below said position when a strand (7'') of square or similar section is being cast.

4. A device according to claim 3, characterized in that the two extractor rollers (11, 12) for round-section strands (7') and at least the upper extractor roller (13) for square-section strands (7'') are mounted each in a supporting slide (111, 112, 113) which is vertically slidably guided by guides in the frame (16) of the device, the two upper extractor rollers (11 and 13) being displaced by means of a hydraulic cylinder (17, 23), while the supporting slide (112) of the lower extractor roller (12) for round-section strands (7') is displaced by means of at least an underlying stepped (119) rectilinear cam (19) which is movable on wheels (20) and is actuatable by means of a hydraulic cylinder (22), said supporting slide (112) resting on said cam (19) through wheels (18).

5. A device according to claim 1, characterized in that the two successive pairs of extractor rollers (11, 12 and 13, 14) are actuated by a common motivating unit (24).

6. A device according to claim 1, characterized in that each extractor roller (11, 12 and 13, 14) is actuated by an associated worm (27)/helical gear (28) unit, the shaft (211, 212, 213, 214) of said worm (27) being disposed vertically and being coupled for rotation in an axially slidable connection with a drive member (29) which, in turn, is coupled for rotation with a motivating unit (24).

* * * * *